US006098341A

United States Patent [19]

Gebauer

[11] Patent Number: 6,098,341

[45] Date of Patent: Aug. 8, 2000

[54] SLIDING DOOR ASSEMBLY FOR A CLEAN ROOM, INCLUDING A PAIR OF PARALLEL INCLINED GUIDE MEMBERS AND AN ACTUATING MEMBER EXTENDING THEREBETWEEN

[76] Inventor: Thorsten Gebauer, Trochtelfinger Strasse 9A, 70567 Stuttgart, Germany

[21] Appl. No.: 09/017,622

[22] Filed: Feb. 2, 1998

[30] Foreign Application Priority Data

Feb. 1, 1997 [DE] Germany ..... 197 03 768

[51] Int. Cl.[7] ..... E05D 15/06; E05F 17/00; E05F 11/34

[52] U.S. Cl. ..... 49/226; 49/228; 49/231; 49/118; 49/362

[58] Field of Search ..... 49/226, 228, 231, 49/116, 118, 409, 366, 370, 362, 360, 120

[56] References Cited

U.S. PATENT DOCUMENTS

| | | | |
|---|---|---|---|
| 575,644 | 1/1897 | Heath et al. | 49/116 |
| 832,457 | 10/1906 | Cossey | 49/116 |
| 987,123 | 3/1911 | Fleischer | 49/116 |
| 1,169,755 | 2/1916 | Abbott | 49/116 |
| 1,411,039 | 3/1922 | Lacey | 49/118 |
| 2,056,174 | 10/1936 | Earhuff et al. | 318/266 |
| 2,878,532 | 3/1959 | Clark | 49/139 |
| 3,166,155 | 1/1965 | Clark | 49/7 |
| 3,175,254 | 3/1965 | Bromann | 49/228 |
| 3,261,128 | 7/1966 | Slopa et al. | 49/98 |
| 3,431,678 | 3/1969 | Stuart et al. | 49/360 |
| 3,473,266 | 10/1969 | Miller | 49/504 |
| 3,842,462 | 10/1974 | Bainbridge | 49/94 R |
| 4,091,570 | 5/1978 | Favrel | 49/118 |
| 4,366,649 | 1/1983 | Weigant | 49/362 |
| 4,423,799 | 1/1984 | Glaser et al. | 187/314 |
| 4,577,577 | 3/1986 | Eriksson | 114/120 |
| 4,876,765 | 10/1989 | Karita . | |
| 5,148,631 | 9/1992 | Bayard et al. | 49/449 |
| 5,301,468 | 4/1994 | Kamezaki | 49/255 |
| 5,347,755 | 9/1994 | Jaster et al. | 49/25 |
| 5,566,505 | 10/1996 | Kamezaki | 49/225 |

FOREIGN PATENT DOCUMENTS

| | | | |
|---|---|---|---|
| 2310101 | 9/1973 | Germany | 49/409 |
| 2807050 | 10/1978 | Germany | 49/360 |
| 3200497A1 | 7/1983 | Germany . | |
| 22806 | 12/1992 | United Kingdom | 49/360 |

*Primary Examiner*—Daniel P. Stodola
*Assistant Examiner*—Gregory J. Strimbu
*Attorney, Agent, or Firm*—Evenson, McKeown, Edwards & Lenahan, P.L.L.C.

[57] ABSTRACT

A sliding door assembly for a clean room for manufacturing precision parts, chemicals and special foods or for carrying out surgical procedures. The door assembly includes a pair of parallel vertically spaced guide shafts which are inclined at an angle to a horizontal and serve to guide the sliding door as it moves from an upper open position into a closed lower position. A door closing and opening actuator includes an actuator shaft extending between the guide shafts. A sealing arrangement of the door assembly becomes operational upon movement of the sliding door to the closed position.

34 Claims, 6 Drawing Sheets

SLIDING DOOR ASSEMBLY FOR A CLEAN ROOM, INCLUDING A PAIR OF PARALLEL INCLINED GUIDE MEMBERS AND AN ACTUATING MEMBER EXTENDING THEREBETWEEN

BACKGROUND AND SUMMARY OF THE INVENTION

This application claims the priority of German application 197 03 768.2 filed in Germany on Feb. 1, 1997, the disclosure of which is expressly incorporated by reference herein.

The invention relates to a sliding door device for a clean room.

The environment of a normal room contains fine dust, dirt particles, and mold. Penetration of such substances into rooms where precision parts, special foods, and/or chemicals are manufactured, or where surgery is performed, must be avoided. See U.S. Pat. No. 4,876,765 for background information. Special attention must be paid in particular to the design of the door for rooms of this kind, in other words, such doors must open in a relatively short time and then be closed in a sealing fashion, with the abrasion of mechanical parts, the guide and actuating devices of the sliding door for example, necessarily being low.

A known sliding door disclosed in German Patent Document, DE 32 00 497 A1, incorporates a running rail diagonal to a horizontal, on which rail the rollers of carriers connected with the sliding door rest. Seals are provided at an upper end area of the sliding door, said seals being operative when the door is closed. This design, however, suffers from the disadvantage that abrasion occurs between the rollers and the rails when the sliding door is opened and closed, said abraded particles entering the clean room as a result of the movement of the various guide parts, especially when the sliding door is closed. In addition, the channel-shaped guide rails that receive the rollers, because of the relatively large tolerances between the rollers and the guide rails, make it difficult to achieve a precise movement of the sliding door that reinforces the sealing effect. Finally, even when the sliding door is closed, undesired particles can pass through the lower boundary of the sliding door and the floor.

Hence a goal of the invention is to provide a sliding door device with a guide device that hermetically seals off the clean room in a closed state, and offers easy and reliable function. Assurance must also be provided, however, that the guide device and sealing arrangement operate and/or are designed to operate without abrasion.

This goal is achieved according to the invention by providing a sliding door device for a clean room, in which a sliding door is lowered into a closed position from an open position by means of a guide device that extends at an angle to a horizontal, and the clean room is protected against the penetration of harmful substances by a sealing arrangement when the door is in the closed position, wherein door guide devices with first and second guide members extending parallel to one another and to an actuating device for the sliding door, are provided, which guide members and actuating device are aligned accordingly at an angle, and wherein a sealing arrangement is provided which includes: a first sealing device provided at an upper end area of the sliding door, a second sealing device provided at a lower end area of the sliding door, and third and fourth sealing devices located on upright boundary areas of the sliding door.

Primary advantages achieved by the invention result from the fact that the guide device and the sealing arrangement ensure a good function of the sliding door device. By virtue of the special arrangement and design, the sealing arrangement protects the clean room against the penetration of substances that must be kept out when the sliding door is closed, such as dust, dirt particles, or the like. The guide members of the guide device, which are designed to be relatively free of wear, guarantee precise travel of the sliding door and a functionally correct position of the sealing arrangement, especially when the sliding door is closed. The guide device is mounted at an angle to a horizontal, so that it raises the first and second sealing devices, suspending their sealing functions when the sliding door is opened and lowers them back into the initial position when the door is closed, largely without wear.

The guide elements which resemble bushings and the sliding shafts create a design principle that exhibits good travel properties and takes up little space. Likewise, the second guide member can be connected with the sliding door in simple fashion by means of supporting devices installed in the adjusting devices. In addition, the actuating device is a screw drive composed of an actuating shaft and a movable member well-suited for the selected application.

The actuating assembly permits smooth closing and opening of the sliding door, which is important when the clean room is subject to heavy traffic.

The guide device is also suitable for a sliding door with two sliding door elements displaceable in a common plane. For this purpose, another guide device is employed whose actuating shaft is connected by a clutch with the actuating shaft of the other guide device (both guide devices can have the same design); for this purpose, the screw drives can be made with left-hand or right-hand threads.

An arrangement of the sliding shafts and actuating shafts that is compact as well as being favorable from the standpoint of the forces involved is achieved when, as viewed in cross-section, their centers lie on a common plane that runs at an angle to a structural plane. Finally, the sliding shafts are located at equal distances from the actuating shaft.

Other objects, advantages and novel features of the present invention will become apparent from the following detailed description of the invention when considered in conjunction with the accompanying drawings.

DETAILED DESCRIPTION OF THE DRAWINGS

Figure 1:
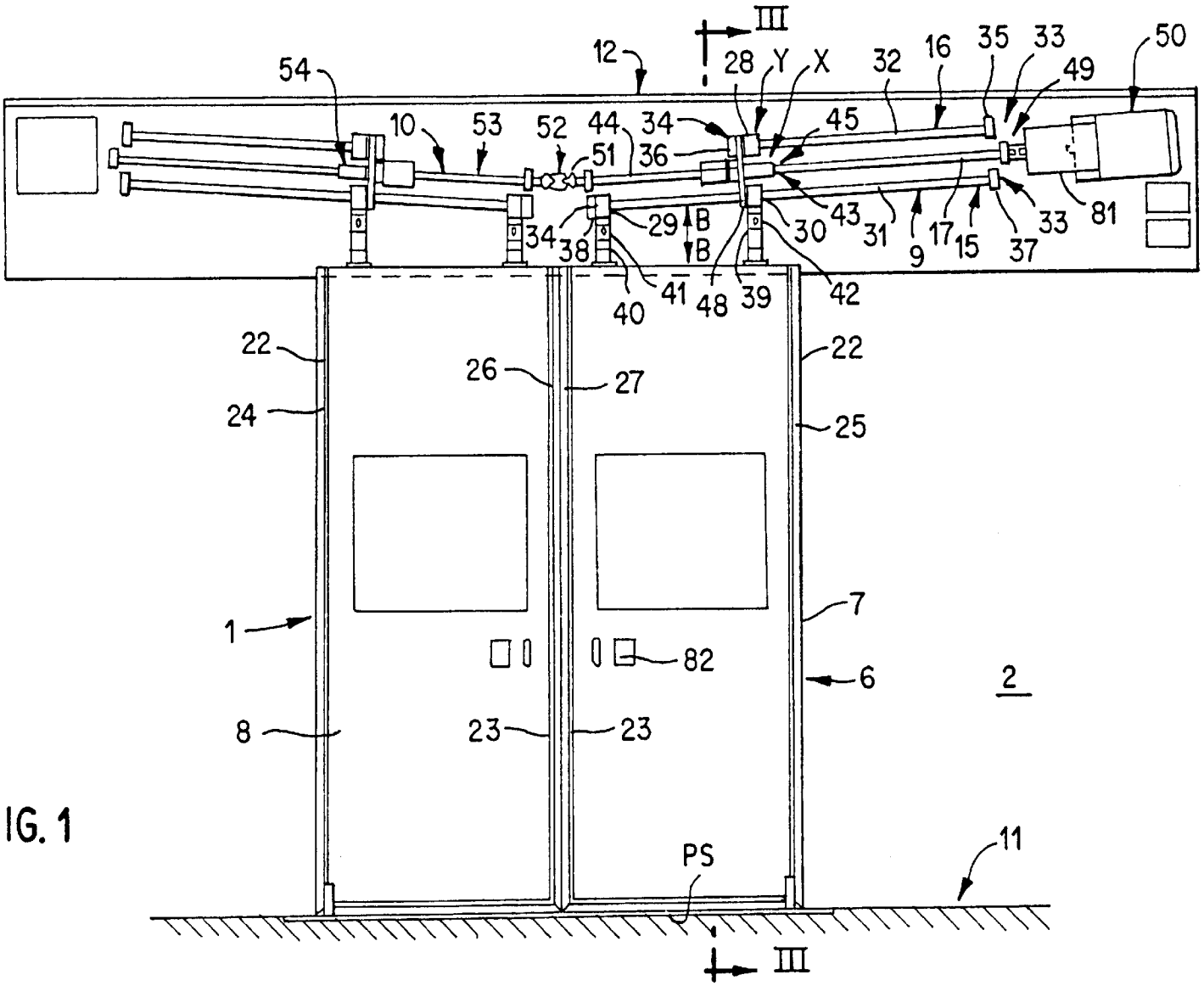
FIG. 1 shows a side view of a sliding door device with the sliding door closed, constructed according to a preferred embodiment of the present invention.

A sliding door device 1 is located on the exterior of a wall 2 of a building, said wall delimiting a clean room 3 in which precision parts, chemicals, or special foods are manufactured and/or surgery is performed. Sliding device 1 seals clean room 3 in the vicinity of a door opening 4 provided in wall 2, and connecting clean room 3 with an antechamber 5.

Sliding door device 1 comprises a sliding door 6, which according to FIG. 1 comprises a first sliding door element 7 and a second sliding door element 8. The technology described below can also be used in a sliding door that has only a single sliding door element.

Figure 2:
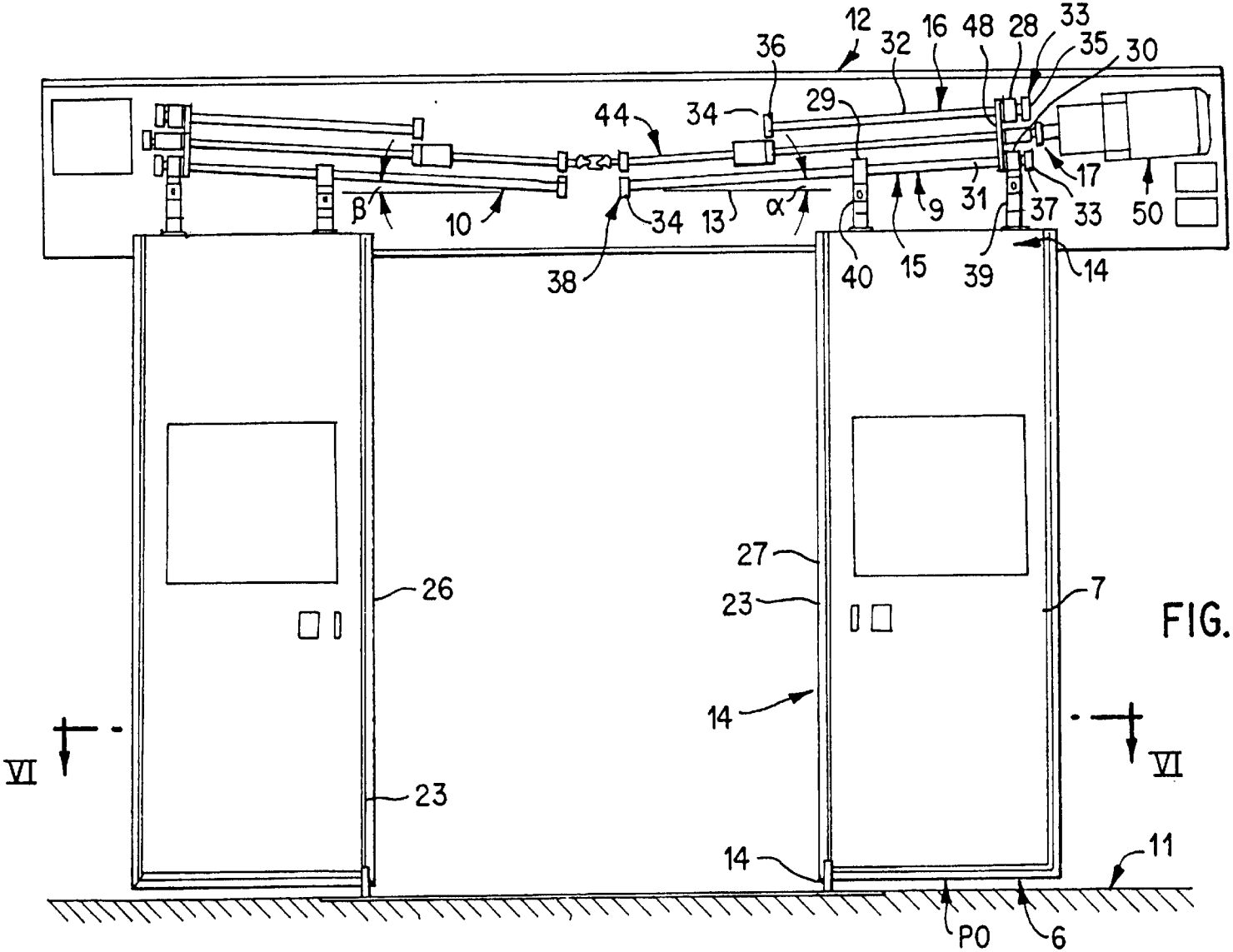
FIG. 2 is a view corresponding to FIG. 1 with the sliding door open.
Figure 3:
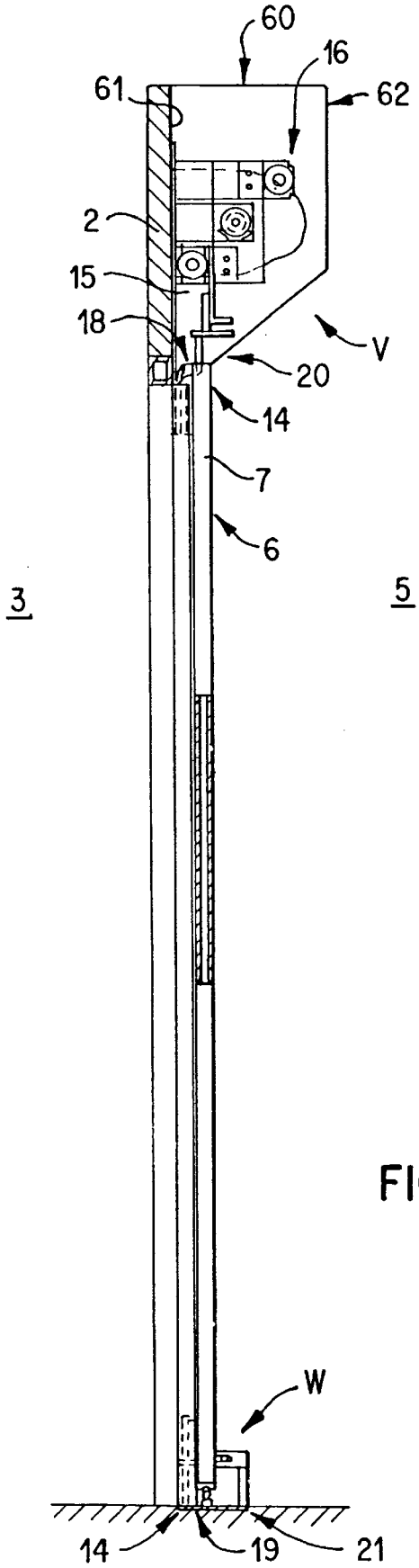
FIG. 3 is a section along line III—III in FIG. 1 on an enlarged scale.
Figure 4:
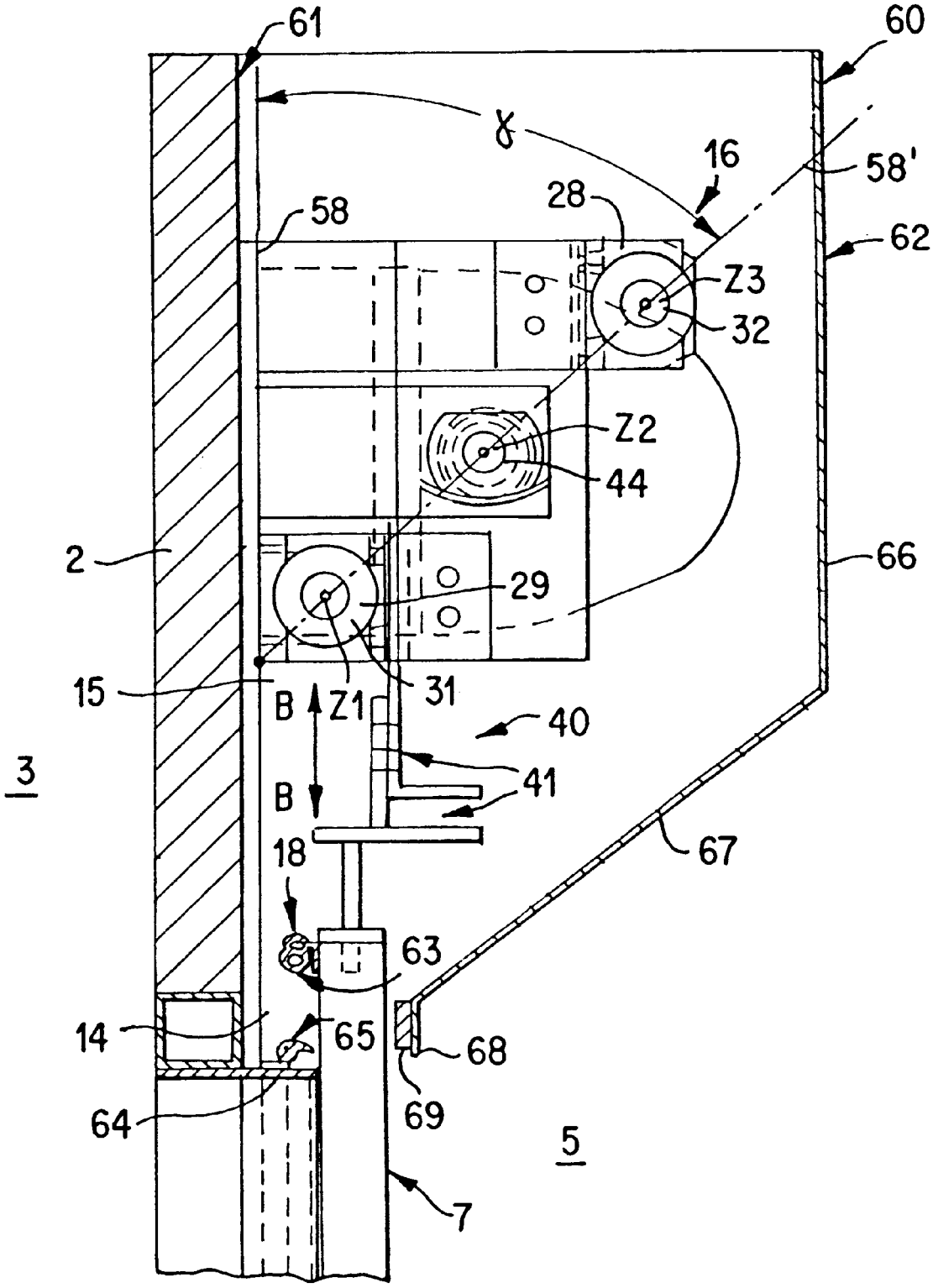
FIG. 4 is a view showing detail V of FIG. 3 on an enlarged scale.

The plane sliding door elements 7, 8 extend along a common plane A—A (FIG. 6) and can be moved from a closed position PS, FIGS. 1 and 3, into an open position PO, FIGS. 2 and 4, and vice versa. For this purpose, the first and second guide devices 9, 10 are used, said devices being located on a side 12 of sliding door elements 7 that faces away from a flat floor 11. Guide device 9 extends at an angle $\alpha$ which can be between 2°30' and 4°30' to a horizontal 13 while guide device 10 runs at a similar angle $\beta$ (FIG. 2). As a result, sliding door elements 7, 8 are lowered when moved out of open position PO into closed position PS. In this state, a sealing system 14 becomes operational, which ensures that clean room 3 is secured against the penetration of undesired particles, substances, or the like.

Guide device 9 is formed by parallel first and second guide members 15 and 16, and an actuating device 17, by which sliding door 6 is moved.

Sealing arrangement 14 comprises a first sealing device 18 and a second sealing device 19, provided at an upper end area 20 and a lower end area 21 of sliding door 6 (FIG. 3). In addition, sealing arrangement 14 comprises a third sealing device 22 and a fourth sealing device 23 (FIG. 6) that are provided on upright boundary areas 24, 25 and 26, 27 of sliding door elements 7, 8 of sliding door 6.

Referring to FIGS. 1 and 2, guide members 15, 16 include is guide elements 28, 29, 30 resembling bushings, FIGS. 1 and 2, said elements being mounted movably relative to one another on sliding shafts 31, 32. Sliding shafts 31, 32 are held in place at their ends 33, 34 by means of fastening elements 35, 36; 37, 38. Fastening elements 35, 36; 37, 38 surround sliding shafts 31, 32.

The guide members 15 are connected with sliding door element 7 by supporting devices 39, 40 spaced apart from one another. Adjusting devices 41, 42, are integrated into supporting devices 39, 40, by means of which devices 41, 42 door element 7 can be adjusted heightwise in direction B—B, FIGS. 1 and 4.

Figure 7:
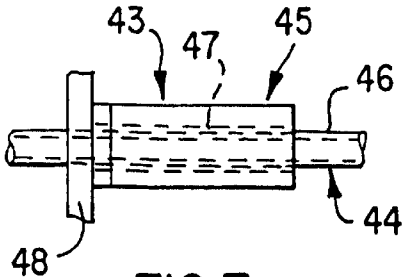
FIG. 7 is a view showing detail X in FIG. 1.

Actuating device 17 extends between guide members 15, 16 and is represented by a screw drive 43 of the roller ring thread design that has an actuating shaft 44 and a movable member 45. Actuating shaft 44 comprises an external thread 46 and movable member 45 has an internal thread 47 as illustrated schematically in FIG. 7.

Guide elements 28, 30 and movable member 45 are mounted on a supporting plate 48 aligned perpendicularly to sliding shafts 31, 32.

At a first end 49 of actuating shaft 44, an actuating assembly 50 is located, said assembly being an electric motor in the embodiment illustrated. At a second end 51 of actuating shaft 44, a clutch 52 is mounted, said clutch preferably being an angle joint that operates without wear and connects an actuating shaft 53 of guide device 10 with actuating shaft 44. For this purpose, screw drives 43 and 54 of the two guide devices 9, 10 have left-hand and right-hand threads. With the exception of screw drives 43, 54, the elements of guide devices 9, 10 have the same design.

It is evident from FIG. 4 that actuating shaft 44 and sliding shafts 31, 32 have their centers Z1, Z2, Z3 lying in a common plane 58', with sliding shafts 31, 32 being located equally spaced from actuating shaft 44. Plane 58' extends at an angle $\gamma$ of 45° to a vertical structural plane.

Figure 8:
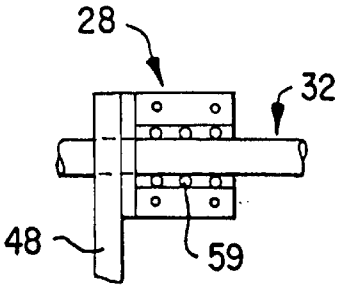
FIG. 8 is a view showing detail Y in FIG. 1.

Guide devices 9, 10, especially the moving parts of guide members 16 and actuating device 17, are designed to be free of wear by virtue of their specific design and choice of material. Ball bearings 59 are provided for this purpose between sliding shafts 31, 32 and guide elements 28, 29, 30 (FIG. 8).

According to FIG. 3, first sealing device 18 is located inside a housing 60, said housing being located outside clean room 3, in other words in antechamber 5 on wall 2. Housing 60 is formed by a local section 61 of wall 2 and a housing box 62. Sealing device 18 is mounted between wall 2 and sliding door element 7, in other words at a distance from the latter, and has a sealing body 63 fastened to sliding door element 7 and a sealing element 65 mounted on a supporting section 64 of wall 2 (FIG. 4).

Housing box 62 is formed by a first wall section 66 extending parallel to wall 2, from which section 66 a second wall section 67 extends up to sliding door element 7 with a flange 68. A section 69 is located between flange 68 and sliding door element 7 that serves to reinforce housing box 62.

Figure 5:
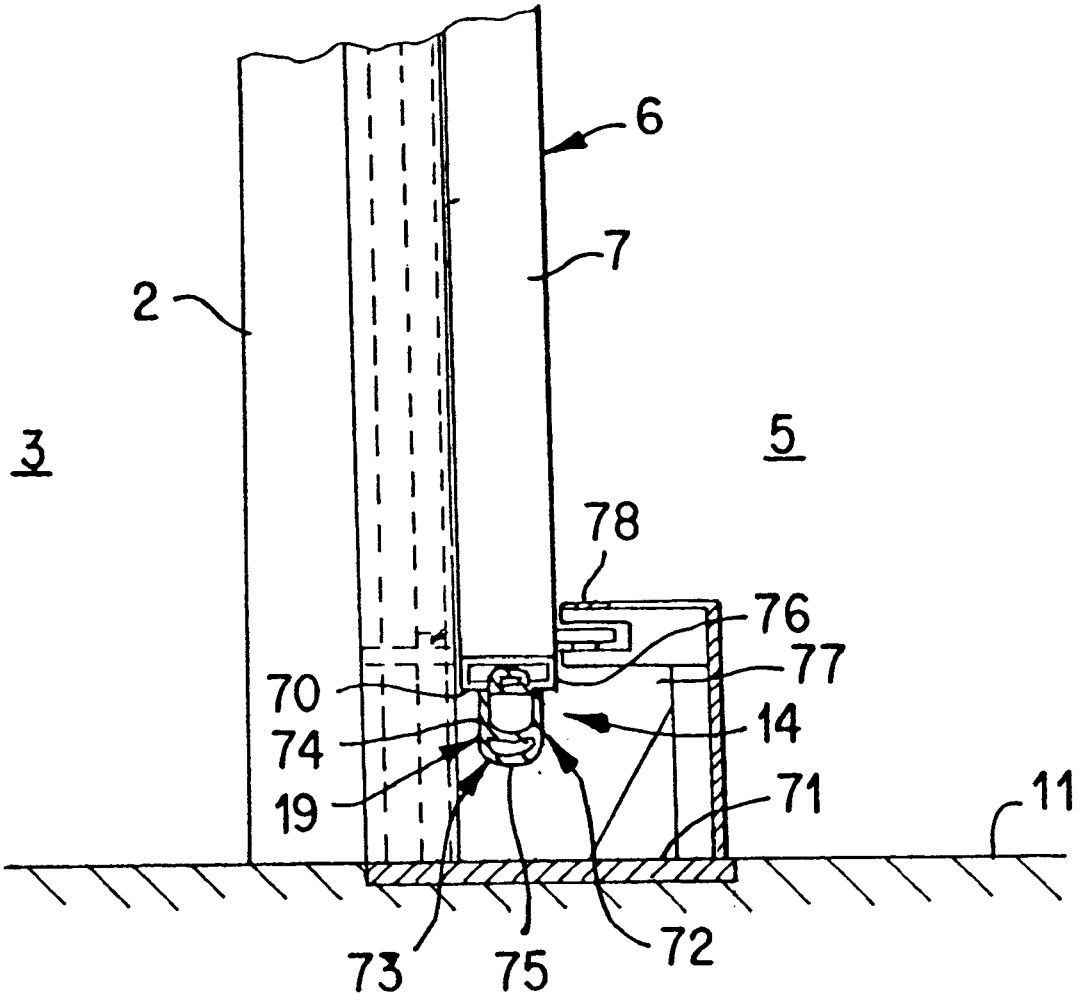
FIG. 5 is a view showing detail W in FIG. 3 on an enlarged scale.

FIG. 5 shows the second sealing device 19 which is operational between a lower limit 70 of sliding door element 7 and a base plate 71 that rests on floor 11. Second sealing device 19 is formed by a sealing body 72 that comprises successive hollow bodies 73, 74 (hollow body 74 is designed as sealing section 75), said sealing body 72 together with a lower end area 76 of sliding door element 7 being accommodated in a floor box 77 that surrounds sliding door element 7 on all sides. Guide elements formed by rollers 78 for sliding door element 7 are provided inside floor box 77. They are located outside clean room 3.

Figure 6:
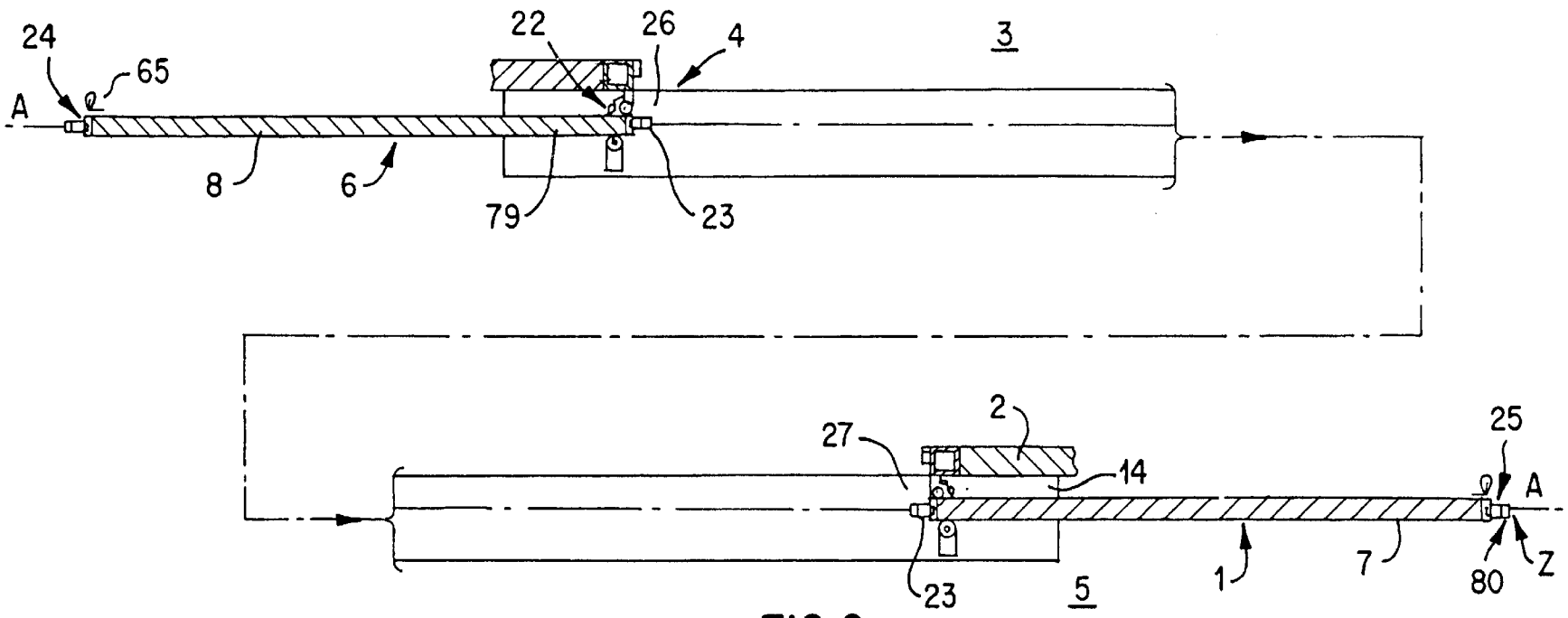
FIG. 6 is a view showing section along line VI—VI in FIG. 2 on an enlarged scale.

The third sealing device 22 is located at 79, FIG. 6, between sliding door element 8 and wall 2 on the upright boundary areas 24. This device 22 is designed like first sealing device 18, FIG. 4.

Finally, on the upright boundary areas 26, 27 that face one another and the boundary areas 24, 25 located at a distance from them, the fourth sealing device 23 is mounted in each case. This device 23 is designed in the same way as second sealing device 19, FIG. 5.

Figure 9:
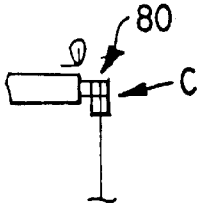
FIG. 9 is a view showing detail Z in FIG. 6 combined with an electrical circuit diagram.

It follows from FIG. 9 that an elastic body is provided on the outer boundary areas 24, 25, said body acting as an electrical protective contact strip 80 and being designed similarly to the fourth sealing device 23.

Protective contact strip 80 is operational in direction C at a defined load, so that sliding door 6 is opened by an electrical control, not shown.

Between actuating assembly 50 and actuating shaft 44, an electromagnetic clutch 81, FIGS. 1 and 2, is located, said clutch separating actuating shaft 44 from actuating assembly 50, when a problem affects sliding door 6. In this state, sliding door 6 can be operated manually.

During normal operation, to move sliding door 6 into the open position PO, door contact switch 82, FIG. 1, is operated, causing actuating assembly 50 to drive actuating shaft 44. In order to move sliding door 6 into its closed position PS, it is possible to provide a time-delay relay, which switches actuating assembly 50 after a specified period of time in such fashion that sliding door 6 is moved into its closed position PS. Finally, it is also possible to use door contact switch 82 to close sliding door 6.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Sliding door assembly for closing a room opening, comprising:

a first door, first and second guide members extending parallel to and spaced vertically from one another, said first and second guide members being inclined vertically, a first door carrying device connected to said first door and movably guided by said first guide member, an actuating device having a first actuating member disposed between the first and second guide members, said actuating device being operable to move the first door carrying device and first door along an inclined path parallel to the first and second guide members between an upper open position and a lower closed position, and a sealing arrangement including respective sealing devices for an upper end area of the first door, a lower end area of the first door, and upright lateral boundary areas of the first door, wherein said first and second guide members are first and second guide shafts, and wherein said first door carrying device is connected to an upper portion of the first door and to a first bushing slidably disposed on the first guide shaft.

2. A sliding door assembly according to claim 1, wherein a second door carrying device is provided, said first and second door carrying devices being connected to said first door at positions spaced from one another, and wherein said second door carrying device is connected to the upper portion of the first door and to a second bushing slidably disposed on the first guide shaft.

3. A sliding door assembly according to claim 2, wherein each of said door carrying devices includes an adjusting mechanism operable to facilitate adjusting movement of the first door with respect to the first guide shaft.

4. A sliding door assembly according to claim 2, wherein said first guide shaft is configured to be fastened to a fixed structure adjacent the opening.

5. A sliding door assembly according to claim 2, wherein said actuating device includes a first supporting plate which in use is guidably moved along said first actuating member during movement of the first door between the open and closed positions, wherein a third bushing is slidably guidably disposed on the second guide shaft, and wherein said first supporting plate is connected to and movable together with said first bushing and said third bushing.

6. A sliding door assembly according to claim 5, wherein said second bushing is disposed closer to the opening than said first bushing when said door is in said open position.

7. A sliding door assembly according to claim 5, wherein said first and second guide shafts are configured to be fastened to a fixed structure adjacent the opening.

8. A sliding door assembly according to claim 5, wherein the first actuating member comprises a screw drive for moving the first supporting plate along the actuating member.

9. A sliding door assembly according to claim 1, wherein said first guide shaft is configured to be fastened to a fixed structure adjacent the opening.

10. A sliding door assembly according to claim 1, wherein the first actuating member comprises a screw drive for moving a first movable member connected with the first door carrying device along the actuating member.

11. A sliding door assembly according to claim 10, wherein the actuating device includes an electric motor for rotating said actuating member.

12. A sliding door assembly according to claim 1, wherein said room opening is provided in a clean room, and wherein the sealing arrangement is operable to seal said opening with respect to clean room contaminants.

13. A sliding door assembly according to claim 1, wherein said first door carrying device includes an adjusting mechanism operable to facilitate adjusting movement of the first door with respect to the first guide member.

14. A sliding door assembly according to claim 1, comprising:

a second door which has a lateral upright boundary facing an upright lateral boundary of said first door, third and fourth guide members extending parallel to and vertically spaced from one another, said third and fourth guide members being inclined vertically, at least one further door carrying device connected to said second door and movably guided by said third guide member, and wherein said actuating device includes a second actuating member disposed between the third and fourth guide members, said actuating device being operable to move the further door carrying device and said second door along an inclined path parallel to the third and fourth guide members between an open position and a closed position.

15. A sliding door assembly according to claim 14, wherein said at least one further door carrying device includes an adjusting mechanism operable to facilitate adjusting movement of the second door with respect to the third guide member.

16. A sliding door assembly according to claim 14, wherein the second actuating member comprises a screw drive for moving a first movable member along the second actuating member, and wherein said first actuating member is drivingly connected to the second actuating member.

17. A sliding door assembly according to claim 16, wherein said first and second actuating members are respective oppositely inclined shafts joined by a universal joint coupling.

18. A sliding door assembly according to claim 14, wherein said sealing arrangement includes respective sealing devices for an upper end area of the second door, a lower end area of the second door, and upright lateral boundary areas of the second door.

19. A sliding door assembly according to claim 14, wherein said third and fourth guide members are third and fourth guide shafts, and wherein said at least one further door carrying device is connected to an upper portion of the second door and to a further bushing slidably disposed on the third guide shaft.

20. A sliding door assembly according to claim 19, wherein said third and fourth guide shafts are configured to be fastened to a fixed structure adjacent the opening.

21. A sliding door assembly according to claim 14, wherein a second door carrying device is provided, said first and second door carrying devices being connected to said first door at positions spaced from one another, wherein said second door carrying device is connected to the upper portion of the first door and to a second bushing slidably disposed on the first guide shaft, wherein said third and fourth guide members are third and fourth guide shafts, and wherein the at least one further door carrying device comprises third and fourth door carrying devices, said third and fourth door carrying devices being connected to said second door at positions spaced from one another.

22. A sliding door assembly according to claim 21, wherein each of said third and fourth door carrying devices includes an adjusting mechanism operable to facilitate adjusting movement of the second door with respect to the third guide shaft.

23. A sliding door assembly according to claim 21, wherein said actuating device includes a first supporting plate which is guidably moved along said first actuating member during movement of the first door between the open and closed positions, wherein a third bushing is slidably guidably disposed on the second guide shaft, wherein said first supporting plate is connected to and movable together with said first bushing and said third bushing, wherein said second actuating member carries a second supporting plate which is moved along said second actuating member during movement of the second door between the open and closed position, wherein a further bushing is slidably disposed on the fourth guide shaft, and wherein said second supporting plate is connected to and movable together with said further bushing and said at least one further door carrying device.

24. A sliding door assembly according to claim 23, wherein the actuating members comprise screw drives for moving the first supporting plate along the first and second guide shafts and the second supporting plate along the third and fourth guide shafts.

25. A sliding door assembly according to claim 24, wherein the first and second actuating members are connected to rotate together, and wherein the first and second actuating members have respective oppositely operating threads so that rotation of said first and second actuating members applies one of a opening force and a closing force to the doors.

26. Sliding door assembly for closing a room opening, comprising:

a first door, first and second guide members extending parallel to and spaced from one another, said first and second guide members being inclined vertically, a first door carrying device connected to said first door and movably guided by said first guide member, an actuating device having a first actuating member operable to move the first door carrying device and first door along an inclined path parallel to the first and second guide members between an open position and a closed position, and a sealing arrangement including respective sealing devices for an upper end area of the first door, a lower end area of the first door, and upright lateral boundary areas of the first door, wherein said first and second guide members are first and second guide shafts, wherein a second door carrying device is provided, said first and second door carrying devices being connected to said first door at positions spaced from one another, wherein each of said first and second door carrying devices are connected respectively to an upper portion of the first door and to a respective first and second bushing slidably disposed on the first guide shaft, wherein said actuating device includes a supporting plate which is guidably moved along said first actuating member during movement of the first door between the open and closed positions, wherein a third bushing is slidably guidably disposed on the second guide shaft, and wherein said supporting plate is connected to and movable together with said first bushing and said third bushing.

27. A sliding door assembly according to claim 26, wherein said actuating member extends parallel to and in between the first and second guide shafts.

28. A sliding door assembly according to claim 26, wherein the first actuating member comprises a screw drive for moving the supporting plate along the actuating member.

29. A sliding door assembly according to claim 28, wherein the actuating device includes an electric motor for rotating said actuating member.

30. A sliding door assembly according to claim 29, wherein said room opening is provided in a clean room, and wherein the sealing arrangement is operable to seal said opening with respect to clean room contaminants.

31. A sliding door assembly according to claim 26, wherein said first and second guide shafts are vertically spaced from one another.

32. A sliding door assembly according to claim 31, wherein said actuating member extends parallel to and in between the first and second guide shafts.

33. A sliding door assembly according to claim 31, comprising a second door disposed symmetrically with respect to said first door, wherein said actuating device includes a second actuating member connected with the first actuating member for movement therewith.

34. A sliding door assembly according to claim 33, wherein the actuating device includes an electric motor drive for rotatably driving said actuating members.

* * * * *